US010762847B2

(12) United States Patent
Chen

(10) Patent No.: US 10,762,847 B2
(45) Date of Patent: Sep. 1, 2020

(54) PIXEL CIRCUIT COMPENSATION METHOD AND DEVICE, DISPLAY PANEL AND DISPLAY DEVICE

(71) Applicant: BOE TECHNOLOGY GROUP CO., LTD., Beijing (CN)

(72) Inventor: Yi Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/160,720

(22) Filed: Oct. 15, 2018

(65) Prior Publication Data

US 2019/0130837 A1 May 2, 2019

(30) Foreign Application Priority Data

Oct. 27, 2017 (CN) ..... 2017 1 1023216

(51) Int. Cl.
*G09G 3/3258* (2016.01)
*G09G 3/00* (2006.01)
*G09G 3/3233* (2016.01)

(52) U.S. Cl.
CPC ..... *G09G 3/3258* (2013.01); *G09G 3/006* (2013.01); *G09G 3/3233* (2013.01); *G09G 2320/0295* (2013.01); *G09G 2330/08* (2013.01); *G09G 2330/10* (2013.01)

(58) Field of Classification Search
CPC .... G09G 3/006; G09G 3/3233; G09G 3/3258; G09G 2320/0295; G09G 2330/08; G09G 2330/10
See application file for complete search history.

(56) References Cited

U.S. PATENT DOCUMENTS

2003/0113007 A1 6/2003 Iwasaki et al.
2004/0183791 A1 9/2004 Yoshida et al.
2004/0239596 A1* 12/2004 Ono ..... G09G 3/3233 345/76
2006/0164407 A1* 7/2006 Cok ..... G09G 3/20 345/204
2008/0001855 A1* 1/2008 Hamer ..... G09G 3/3291 345/76
2009/0058772 A1* 3/2009 Lee ..... G09G 3/3233 345/82
2010/0134479 A1* 6/2010 Takasugi ..... G09G 3/32 345/214

(Continued)

FOREIGN PATENT DOCUMENTS

CN 1462373 A 12/2003
CN 1519809 A 8/2004

(Continued)

OTHER PUBLICATIONS

First Chinese Office Action dated Mar. 11, 2019, received for corresponding Chinese Application No. 201711023216.X.

*Primary Examiner* — Mihir K Rayan
(74) *Attorney, Agent, or Firm* — Kinney & Lange, P.A.

(57) ABSTRACT

A pixel circuit compensation method is provided, including: acquiring a threshold voltage of a driving transistor in each subpixel of a display panel; determining whether there is an abnormal voltage in the threshold voltages; and when there is the abnormal voltage, adjusting a compensation signal to be applied to a first subpixel corresponding to the abnormal voltage.

17 Claims, 4 Drawing Sheets

(56) References Cited

U.S. PATENT DOCUMENTS

| | | | | |
|---|---|---|---|---|
| 2012/0139955 | A1 | 6/2012 | Jaffari et al. | |
| 2012/0179411 | A1 | 7/2012 | Sugimura | |
| 2013/0147355 | A1 | 6/2013 | Min et al. | |
| 2014/0266217 | A1 | 9/2014 | Wang et al. | |
| 2015/0145845 | A1* | 5/2015 | Nam | G09G 3/3233 345/209 |
| 2015/0332979 | A1 | 11/2015 | Yang et al. | |
| 2016/0078805 | A1 | 3/2016 | Woo et al. | |
| 2016/0117974 | A1* | 4/2016 | Back | G09G 3/3275 345/213 |
| 2016/0189612 | A1 | 6/2016 | Lee et al. | |
| 2017/0169767 | A1 | 6/2017 | Song | |
| 2018/0108297 | A1 | 4/2018 | Wang et al. | |

FOREIGN PATENT DOCUMENTS

| | | | |
|---|---|---|---|
| CN | 102486912 | A | 6/2012 |
| CN | 102628910 | A | 8/2012 |
| CN | 102723311 | A | 10/2012 |
| CN | 103150984 | A | 6/2013 |
| CN | 104062532 | A | 9/2014 |
| CN | 104658476 | A | 5/2015 |
| CN | 104809986 | A | 7/2015 |
| CN | 105427796 | A | 3/2016 |
| CN | 105551415 | A | 5/2016 |
| CN | 105679219 | A | 6/2016 |
| CN | 105761673 | A | 7/2016 |
| KR | 20070118857 | A | 12/2007 |
| KR | 20150077171 | A | 7/2015 |

* cited by examiner

PIXEL CIRCUIT COMPENSATION METHOD AND DEVICE, DISPLAY PANEL AND DISPLAY DEVICE

CROSS-REFERENCE TO RELATED APPLICATION

The present application claims a priority of Chinese patent application No. 201711023216.X filed on Oct. 27, 2017, which is incorporated herein by reference in its entirety.

TECHNICAL FIELD

The present disclosure relates to the field of display technology, in particular to a pixel circuit compensation method, a pixel circuit compensation device, a display panel and a display device.

BACKGROUND

For an organic light-emitting diode (OLED) display panel, such a problem as drift may probably occur for a threshold voltage Vth of a driving transistor, thereby an image may be abnormally displayed on the display panel. In the related art, the difference in the threshold voltage Vth due to the drift is canceled mainly through detecting the threshold voltage Vth of the driving transistor at a sensing stage and providing a corresponding compensation value.

However, a broken circuit or short circuit may occur for a sense line or a switching transistor of the display panel, so the threshold voltage collected at the sensing stage may be inaccurate, and thereby the resultant compensation value may be inaccurate too.

SUMMARY

A pixel circuit compensation method is provided in some embodiments of the present disclosure, including: acquiring a threshold voltage of a driving transistor in each subpixel of a display panel; determining whether there is an abnormal voltage in the threshold voltages; and when there is the abnormal voltage, adjusting a compensation signal to be applied to a first subpixel corresponding to the abnormal voltage.

Optionally, the determining whether there is the abnormal voltage includes: determining whether the threshold voltages applied to all subpixels in a same row or a same column are the same; and when the threshold voltages applied to all the subpixels in the same row or same column are the same, determining the threshold voltages applied to all the subpixels in the same row or same column as the abnormal voltages.

Optionally, the determining whether there is the abnormal voltage includes: determining whether each threshold voltage is within a predetermined voltage range; and when the threshold voltage is not within the predetermined voltage range, determining the threshold voltage as the abnormal voltage.

Optionally, the determining whether the threshold voltages are within the predetermined voltage range includes: determining whether each threshold voltage is greater than an upper limit value of the predetermined voltage range or smaller than a lower limit value of the predetermined voltage range; and when the threshold voltage is greater than the upper limit value or smaller than the lower limit value, determining that the threshold voltage is not within the predetermined voltage range.

Optionally, the adjusting the compensation signal to be applied to the subpixel corresponding to the abnormal voltage includes: determining, among the subpixels adjacent to the first subpixel, whether there is at least one second subpixel whose threshold voltage is not the abnormal voltage; when there is the at least one second subpixel, determining the threshold voltage of the at least one second subpixel as an alternative voltage; and applying the compensation signal to the first subpixel in accordance with the alternative voltage.

Optionally, when there is a plurality of second subpixels, the determining the alternative voltage in accordance with the threshold voltage of the at least one second subpixel includes calculating an average voltage of the threshold voltages of the plurality of second subpixels as the alternative voltage.

Optionally, the determining the alternative voltage in accordance with the threshold voltage of the at least one second subpixel includes determining, among the second subpixels, the threshold voltage of the second subpixel in a same row or a same column as the first subpixel as the alternative voltage.

Optionally, subsequent to determining the abnormal voltage, the pixel circuit compensation method further includes writing information about the first subpixel corresponding to the abnormal voltage into a memory. Prior to the adjusting the compensation signal to be applied to the first subpixel corresponding to the abnormal voltage, the pixel circuit compensation method further includes: extracting the information from the memory; and determining the first subpixel corresponding to the abnormal voltage in accordance with the information.

Optionally, prior to determining the abnormal voltage, the pixel circuit compensation method further includes generating an image of back panel characteristics in accordance with the acquired threshold voltage.

A pixel circuit compensation device is further provided in some embodiments of the present disclosure, including: a voltage acquisition circuit configured to acquire a threshold voltage of a driving transistor in each subpixel of a display panel; an abnormality determination circuit configured to determine whether there is an abnormal voltage; and a compensation adjustment circuit configured to adjust a compensation signal to be applied to a first subpixel corresponding to the abnormal voltage.

Optionally, the abnormality determination circuit is further configured to: determine whether the threshold voltages applied to all subpixels in a same row or a same column are the same; and when the threshold voltages applied to all the subpixels in the same row or same column are the same, determine the threshold voltages applied to all the subpixels in the same row or same column as the abnormal voltages.

Optionally, the abnormality determination circuit is further configured to: determine whether each threshold voltage is within a predetermined voltage range; and when the threshold voltage is not within the predetermined voltage range, determine the threshold voltage as the abnormal voltage.

A display panel is further provided in some embodiments of the present disclosure, including the above-mentioned pixel circuit compensation device.

A display device is further provided in some embodiments of the present disclosure, including the above-mentioned display panel.

BRIEF DESCRIPTION OF THE DRAWINGS

The following drawings are incorporated into and constitute a part of the description, so as to facilitate the understanding of the present disclosure.

DETAILED DESCRIPTION OF EMBODIMENTS

Figure 1:
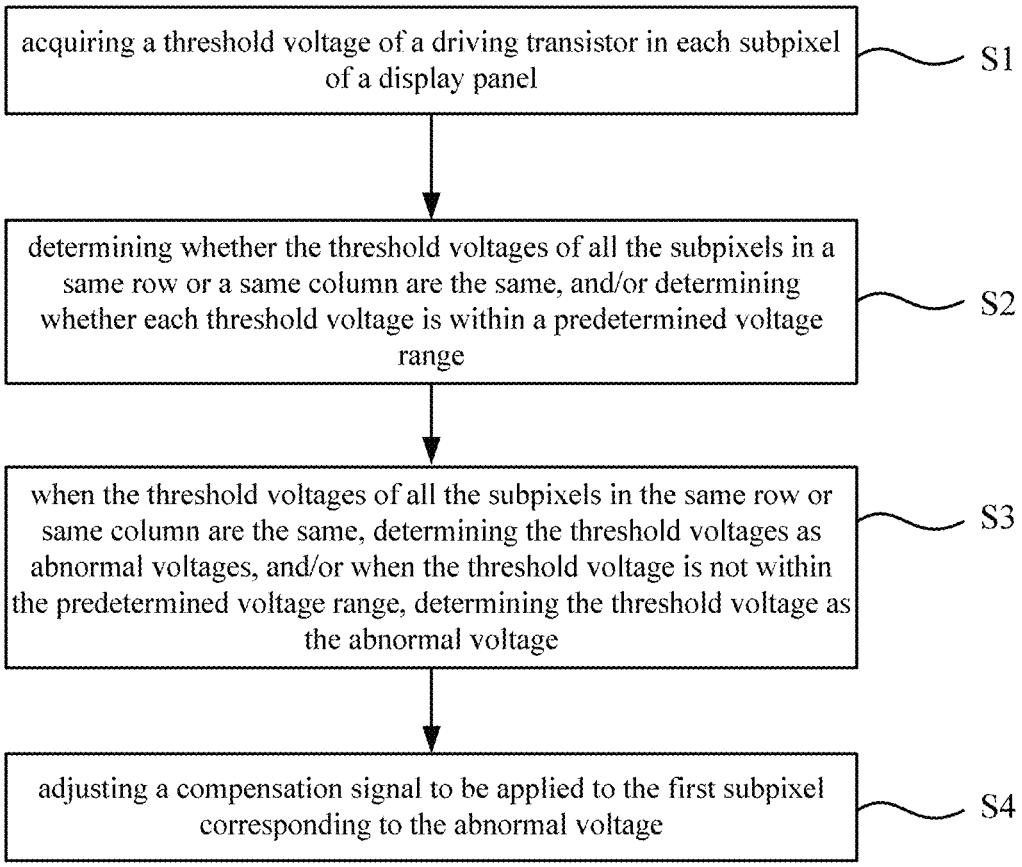
FIG. 1 is a flow chart of a pixel circuit compensation method in some embodiments of the present disclosure.

The present disclosure will be described hereinafter in conjunction with the embodiments and drawings. In the following description, unless otherwise specified, same reference numbers in the drawings represent a same or similar element. The implementation modes involved in the following embodiments shall not be construed as representing all the implementation modes, and instead, they merely relate to examples of the devices and methods as those mentioned in the appended claims.

The present disclosure provides in some embodiments a pixel circuit compensation method applied to a display panel (e.g., an OLED display panel), which includes the following steps.

Step S1: acquiring a threshold voltage of a driving transistor in each subpixel of the display panel.

Figure 2:
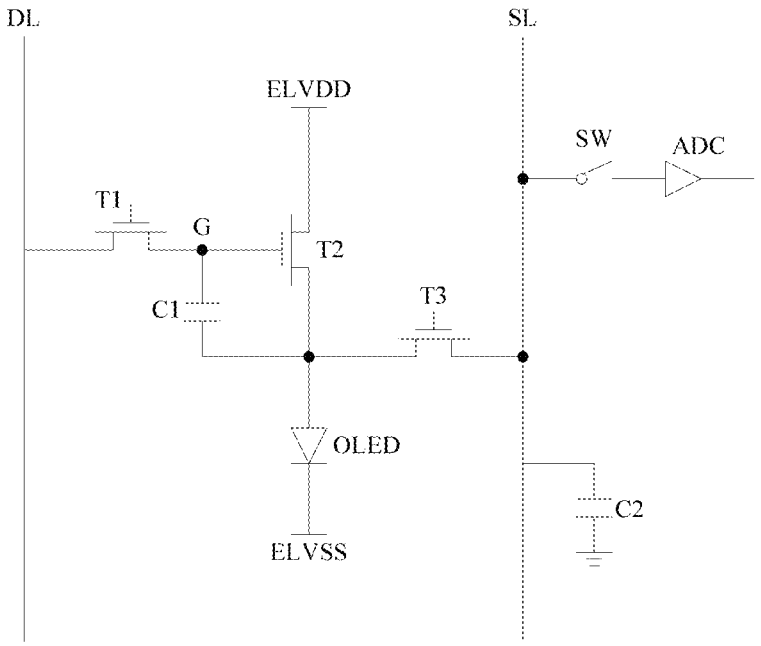
FIG. 2 is a circuit diagram of a subpixel in a display panel to which the pixel circuit compensation method in FIG. 1 is adapted.

FIG. 2 is a circuit diagram of the subpixel in the display panel to which the pixel circuit compensation method in FIG. 1 is adapted. The pixel circuit compensation method in FIG. 1 may be adapted to an OLED display panel, and the OLED display panel may consist of a plurality of subpixels, e.g., red subpixels, green subpixels and blue subpixels.

As shown in FIG. 2, a circuit of the subpixel may include a first transistor T1, a second transistor T2 (i.e., the driving transistor), a third transistor T3, a first capacitor C1, and an OLED.

A gate electrode of T1 is electrically connected to a first gate line (not shown), a source electrode of T1 is electrically connected to a data line DL, and a drain electrode of T1 is electrically connected to a gate electrode of T2.

A source electrode of T2 is electrically connected to a high level ELVDD. One end of the OLED is electrically connected to a drain electrode of T2, and the other end of the OLED is electrically connected to a low level ELVSS. The first capacitor C1 is arranged between the gate electrode and the drain electrode of T2.

A gate electrode of T3 is electrically connected to a second gate line (not shown), a source electrode of T3 is electrically connected to the drain electrode of T2, and a drain electrode of T3 is electrically connected to a sensing line SL.

The sensing line SL is grounded through the second capacitor C2, and electrically connected to an analog-to-digital converter ADC via a switch SW.

Optionally, at a sensing stage (which may be located between two adjacent display stages for the display panel), a reference voltage Vref may be applied to a point G, and a high level signal may be applied to the first gate line and the second gate line, so as to turn on T1 and T3, thereby to turn on T2. At this time, a signal from the drain electrode of T2 is applied to the sensing line SL, and then converted into a digital signal through the analog-to-digital converter ADC. A threshold voltage Vth of T2 may be determined in accordance with the digital signal.

Optionally, the acquired threshold voltage of each driving transistor may be stored in a memory, e.g., a flash memory, for the subsequent extraction.

Step S2: determining whether the threshold voltages of all the subpixels in a same row or a same column are the same, and/or determining whether each threshold voltage is within a predetermined voltage range.

Step S3: when the threshold voltages of all the subpixels in the same row or same column are the same, determining the threshold voltages as abnormal voltages, and/or when the threshold voltage is not within the predetermined voltage range, determining the threshold voltage as the abnormal voltage.

Optionally, the acquired threshold voltage may be compared with the other voltages. For example, the acquired threshold voltage may be compared with the threshold voltages of the subpixels in the same row or the same column, so as to determine whether the acquired threshold voltage is the same as the threshold voltages of the subpixels. When the acquired threshold voltage is the same as the threshold voltages of the subpixels, it may be determined as the abnormal voltage. In addition, the acquired threshold voltage may be compared with the lower limit value and/or the upper limit value of the predetermined voltage range. When the acquired threshold voltage is smaller than the lower limit value or greater than the upper limit value, it may be determined as the abnormal voltage.

Optionally, when the sensing line SL or the data line DL in FIG. 2 are short-circuited or broken, the acquired threshold voltages of the subpixels in the same column may be the same. In this way, whether the threshold voltages of the subpixels in the same column are the same may be determined, and when the threshold voltages of the subpixels in the same column are the same, the threshold voltages of the subpixels in the same column may be determined as the abnormal voltages.

Figure 3:
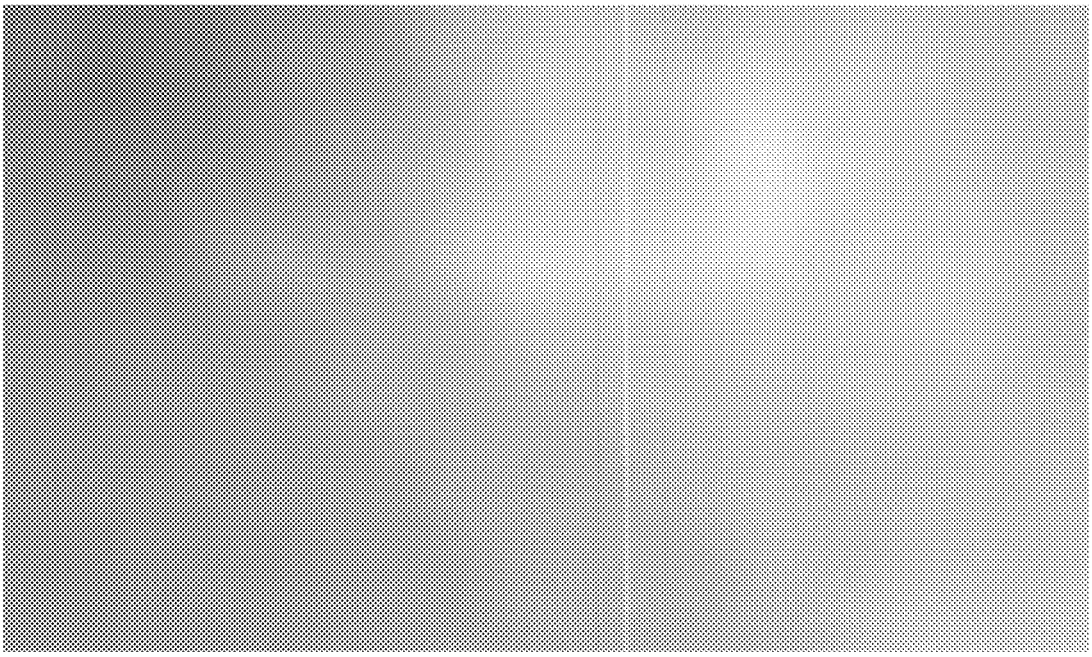
FIG. 3 is an OLED display panel back panel (BP) characteristic image reflecting a distribution of threshold voltages in some embodiments of the present disclosure.

FIG. 3 is an OLED display panel BP characteristic image reflecting a distribution of threshold voltages in some embodiments of the present disclosure.

Optionally, the acquired threshold voltage of each subpixel may be inputted into Matlab, so as to acquire an OLED display panel BP characteristic image, as shown in FIG. 3. Actually, the OLED display panel BP characteristic image may be adopted to intuitively reflect a size of the threshold voltage of each subpixel. The subpixel at a region with a larger brightness value has a smaller threshold voltage, and the subpixel at a region with a smaller brightness value has a larger threshold voltage.

Table 1 shows the threshold voltages of the subpixels corresponding to some regions in FIG. 3.

TABLE 1

| | | | |
|---|---|---|---|
| 82 | 80 | 220 | 87 |
| 78 | 78 | 220 | 85 |
| 80 | 78 | 220 | 89 |
| 81 | 78 | 220 | 83 |

TABLE 1-continued

| | | | |
|---|---|---|---|
| 80 | 81 | 220 | 88 |
| 79 | 74 | 220 | 85 |

In Table 1, the threshold voltages of all the subpixels in a third column are the same, so these threshold voltages may be determined as the abnormal voltages. For example, as shown in FIG. 3, the threshold voltages of the subpixels corresponding to the upright white strip are the same.

Optionally, when a first scanning line connected to T1 or a third scanning line connected to T3 in FIG. 2 is short-circuited or broken, the acquired threshold voltages of the subpixels in the same row may be the same. Hence, whether the threshold voltages of the subpixels in the same row are the same may be determined, and when these threshold voltages are the same, they may be determined as the abnormal voltages.

Optionally, apart from the situation in FIG. 3 where the threshold voltages of the subpixels in the same row and/or the same column are the abnormal voltages, there probably exists such a situation where an individual subpixel fails. For example, when a first transistor T1 of a corresponding subpixel connected to the data line is short-circuited or broken, the threshold voltage of the subpixel may be too large (greater than the upper limit value of the predetermined voltage range) or too small (smaller than the lower limit value of the predetermined voltage range), i.e., beyond the predetermined voltage range. Hence, the predetermined voltage range may be set in advance, and then the threshold voltages beyond the predetermined voltage range may be determined as the abnormal voltages.

Figure 4:
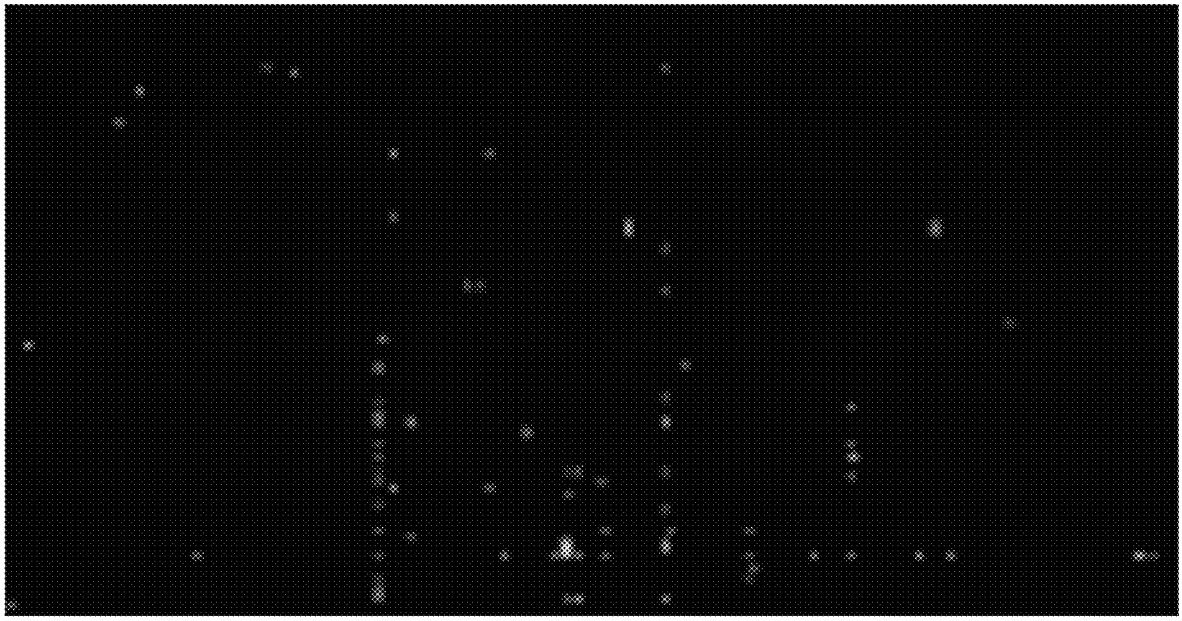
FIG. 4 is an OLED display panel characteristic image reflecting a distribution of abnormal voltages in some embodiments of the present disclosure.

FIG. 4 is an OLED display panel characteristic image reflecting a distribution of abnormal voltages in some embodiments of the present disclosure.

Optionally, the acquired threshold voltage of each subpixel may be inputted into Matlab, so as to acquire an OLED display panel characteristic image, as shown in FIG. 4. The threshold voltage of the subpixel corresponding to a bright point is just the abnormal voltage. When different filtration values are set, the different bright points may be formed in the image.

Step S4: adjusting a compensation signal to be applied to the first subpixel corresponding to the abnormal voltage.

Optionally, a second subpixel, which is adjacent to the first subpixel and whose threshold voltage is not the abnormal voltage, may be determined, and then the threshold voltage of the second subpixel may serve as the threshold voltage of the first subpixel, so as to determine the compensation signal, thereby to apply the compensation signal to the first subpixel.

Optionally, whether the threshold voltage of the driving transistor in each subpixel is the abnormal voltage may be determined through determining whether the threshold voltages of all the subpixels in the same row or same column are the same and/or determining whether the threshold voltages of all the subpixels are within the predetermined voltage range. Then, with respect to the first subpixel corresponding to the abnormal voltage, the compensation signal to be applied thereto may be adjusted, instead of applying a predetermined compensation signal thereto, so as to compensate for the first subpixel in an accurate manner.

Optionally, the determining whether the threshold voltages are within the predetermined voltage range includes: determining whether each threshold voltage is greater than an upper limit value of the predetermined voltage range or smaller than a lower limit value of the predetermined voltage range; and when the threshold voltage is greater than the upper limit value or smaller than the lower limit value, determining that the threshold voltage is not within the predetermined voltage range.

Optionally, the predetermined voltage range may be set in accordance with the practical need.

Figure 5:
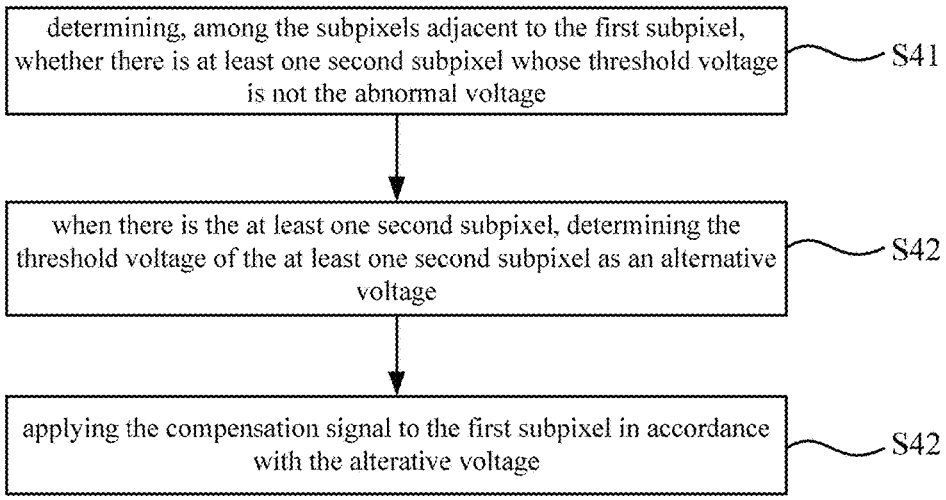
FIG. 5 is a flow chart of the adjustment of a compensation signal in some embodiments of the present disclosure.

FIG. 5 is a flow chart of the adjustment of the compensation signal in some embodiments of the present disclosure. As shown in FIG. 5, the adjusting the compensation signal to be applied to the subpixel corresponding to the abnormal voltage includes: Step S41 of determining, among the subpixels adjacent to the first subpixel, whether there is at least one second subpixel whose threshold voltage is not the abnormal voltage; Step S42 of, when there is the at least one second subpixel, determining the threshold voltage of the at least one second subpixel as an alternative voltage; and Step S43 of applying the compensation signal to the first subpixel in accordance with the alternative voltage.

In the embodiments of the present disclosure, the subpixels adjacent to the first subpixel are manufactured in an environment closest to the first subpixel, so the threshold voltage of the normal subpixel adjacent to the first subpixel is closest to the normal threshold voltage of the first subpixel, and the alternative voltage determined in accordance with the threshold voltage of the second subpixel is closer to the normal threshold voltage of the first subpixel. Hence, the compensation signal to be applied to the first subpixel may be determined in accordance with the alternative voltage.

Optionally, when there is a plurality of second subpixels, the determining the alternative voltage in accordance with the threshold voltage of the at least one second subpixel includes calculating an average voltage of the threshold voltages of the plurality of second subpixels as the alternative voltage.

In the embodiments of the present disclosure, the average voltage of the threshold voltages corresponding to the plurality of second subpixels may be calculated as the alternative voltage. The second subpixels are adjacent to the first subpixel, so the differences between the threshold voltages of the second subpixels and the threshold voltage of the first subpixel may cancel out each other to some extent (e.g., a difference between the threshold voltage of a second subpixel above the first subpixel and the threshold voltage of the first subpixel may cancel out a difference between the threshold voltage of a second subpixel below the first subpixel and the threshold voltage of the first subpixel). Hence, the acquired alternative voltage is closer to the normal threshold voltage of the first subpixel, and the compensation signal to be applied to the first subpixel may be determined accurately in accordance with the alternative voltage.

Optionally, the determining the alternative voltage in accordance with the threshold voltage of the at least one second subpixel includes determining, among the second subpixels, the threshold voltage of the second subpixel in a same row or a same column as the first subpixel as the alternative voltage.

In the embodiments of the present disclosure, among the second subpixels, the threshold voltage of the second subpixel in the same row or the same column as the first subpixel may be determined as the alternative voltage, so as to simplify the calculation process, and reduce the time desired for the adjustment of the compensation signal.

Optionally, subsequent to determining the abnormal voltage, the pixel circuit compensation method further includes writing information about the first subpixel corresponding to the abnormal voltage into a memory. Prior to the adjusting the compensation signal to be applied to the first subpixel corresponding to the abnormal voltage, the pixel circuit compensation method further includes: extracting the information from the memory; and determining the first subpixel corresponding to the abnormal voltage in accordance with the information.

In the embodiments of the present disclosure, after the determination of the abnormal voltage, the first subpixel corresponding to the abnormal voltage as well as the information about the first subpixel (e.g., the information about the row and column where the first subpixel is located, or a relationship (e.g., a list) between the abnormal voltages and the first subpixels) may be determined. Then, the information about the first subpixel corresponding to the abnormal voltage may be stored in the memory (e.g., a flash memory). When it is necessary to compensate for a certain subpixel subsequently, the information may be extracted from the memory, so as to rapidly determine the first subpixel to be compensated.

Optionally, prior to determining the abnormal voltage, the pixel circuit compensation method further includes generating an image of back panel characteristics in accordance with the acquired threshold voltage.

In the embodiments of the present disclosure, the image of the back panel characteristics (e.g., the image in FIG. 4) may be adopted to intuitively represent the size of the threshold voltage of each subpixel. Hence, through generating the image of the back panel characteristics, it is able for an operator to directly determine a region where the abnormal voltages occur, thereby to determine whether the compensation signal needs to be adjusted and how to adjust the compensation signal.

Figure 6:
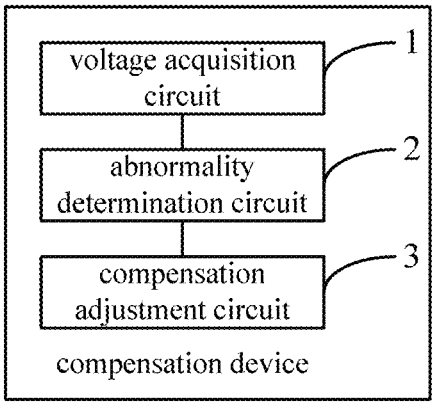
FIG. 6 is a block diagram of a pixel circuit compensation device in some embodiments of the present disclosure.

The present disclosure further provides in some embodiments a pixel circuit compensation device which, as shown in FIG. 6, includes: a voltage acquisition circuit 1 configured to acquire a threshold voltage of a driving transistor in each subpixel of a display panel; an abnormality determination circuit 2 configured to determine whether the threshold voltages of all the subpixels in a same row or a same column are the same, and/or determine whether the threshold voltages are within a predetermined voltage range, when the threshold voltages of all the subpixels in the same row or the same column are the same, determine the threshold voltages of all the subpixels in the same row or the same column as abnormal voltages, and/or when the threshold voltages are not within the predetermined voltage range, determine the threshold voltages as the abnormal voltages; and a compensation adjustment circuit 3 configured to adjust a compensation signal to be applied to a first subpixel corresponding to the abnormal voltage.

The present disclosure further provides in some embodiments a display panel including the above-mentioned pixel circuit compensation device.

The present disclosure further provides in some embodiments a display device including the above-mentioned display panel. It should be appreciated that, the display device may be any product or member having a display function, e.g., electronic paper, mobile phone, flat-panel computer, television, laptop computer, digital photo frame or navigator.

In the embodiments of the present disclosure, such words as "first" and "second" are merely used to differentiate different components rather than to represent any order, number or importance. Further, such a phrase as "a plurality of" is adopted to indicate that there are at least two, e.g., two or three, components, unless otherwise specified.

A person skilled in the art may acquire the other embodiments of the present disclosure by taking the description into consideration and implementing the present disclosure. The present disclosure intends to include any modifications, uses or adaptive alterations, and these modifications, uses or adaptive alterations may follow a general principle of the present disclosure and include any common knowledge or conventional technical means not disclosed in the present disclosure. The description and the embodiments are for illustrative purposes only, and the scope and the spirit of the present disclosure may be reflected by the appended claims.

It should be appreciated that, the present disclosure is not limited to the structures described hereinabove and indicated in the drawings, and various modifications and alterations may be made without departing from the scope of the present disclosure. The scope of the present disclosure is merely limited by the appended claims.

What is claimed is:

1. A pixel circuit compensation method, comprising:

acquiring a threshold voltage of a driving transistor in each subpixel of a display panel;

determining whether there is an abnormal voltage in the threshold voltages; and in response to determining the abnormal voltage, adjusting a compensation signal to be applied to a first subpixel corresponding to the abnormal voltage, wherein determining whether there is the abnormal voltage comprises:

determining whether the threshold voltages applied to all subpixels in a same row or a same column are the same; and when the threshold voltages applied to all the subpixels in the same row or same column are the same, determining the threshold voltages applied to all the subpixels in the same row or same column as the abnormal voltages.

2. The pixel circuit compensation method according to claim 1, wherein determining whether there is the abnormal voltage comprises:

determining whether each threshold voltage is within a predetermined voltage range; and when the threshold voltage is not within the predetermined voltage range, determining the threshold voltage as the abnormal voltage.

3. The pixel circuit compensation method according to claim 2, wherein determining whether each threshold voltage is within the predetermined voltage range comprises:

determining whether each threshold voltage is greater than an upper limit value of the predetermined voltage range or smaller than a lower limit value of the predetermined voltage range; and when the threshold voltage is greater than the upper limit value or smaller than the lower limit value, determining that the threshold voltage is not within the predetermined voltage range.

4. The pixel circuit compensation method according to claim 2, wherein adjusting the compensation signal to be applied to the subpixel corresponding to the abnormal voltage comprises:

determining, among the subpixels adjacent to the first subpixel, whether there is at least one second subpixel whose threshold voltage is not the abnormal voltage;

when there is the at least one second subpixel, determining the threshold voltage of the at least one second subpixel as an alternative voltage; and applying the compensation signal to the first subpixel in accordance with the alternative voltage.

5. The pixel circuit compensation method according to claim 4, wherein when there is a plurality of second subpixels, determining the alternative voltage in accordance with the threshold voltage of the at least one second subpixel comprises calculating an average voltage of the threshold voltages of the plurality of second subpixels as the alternative voltage.

6. The pixel circuit compensation method according to claim 5, wherein determining the alternative voltage in accordance with the threshold voltage of the at least one second subpixel comprises determining, among the second subpixels, the threshold voltage of the second subpixel in a same row or a same column as the first subpixel as the alternative voltage.

7. The pixel circuit compensation method according to claim 2, wherein subsequent to determining the abnormal voltage, the pixel circuit compensation method further comprises writing information about the first subpixel corresponding to the abnormal voltage into a memory, wherein prior to the adjusting the compensation signal to be applied to the first subpixel corresponding to the abnormal voltage, the pixel circuit compensation method further comprises:

extracting the information from the memory; and determining the first subpixel corresponding to the abnormal voltage in accordance with the information.

8. The pixel circuit compensation method according to claim 2, wherein prior to determining the abnormal voltage, the pixel circuit compensation method further comprises generating an image of back panel characteristics in accordance with the acquired threshold voltage.

9. The pixel circuit compensation method according to claim 1, wherein adjusting the compensation signal to be applied to the subpixel corresponding to the abnormal voltage comprises:

determining, among the subpixels adjacent to the first subpixel, whether there is at least one second subpixel whose threshold voltage is not the abnormal voltage;

when there is the at least one second subpixel, determining the threshold voltage of the at least one second subpixel as an alternative voltage; and applying the compensation signal to the first subpixel in accordance with the alternative voltage.

10. The pixel circuit compensation method according to claim 9, wherein when there is a plurality of second subpixels, determining the alternative voltage in accordance with the threshold voltage of the at least one second subpixel comprises calculating an average voltage of the threshold voltages of the plurality of second subpixels as the alternative voltage.

11. The pixel circuit compensation method according to claim 10, wherein determining the alternative voltage in accordance with the threshold voltage of the at least one second subpixel comprises determining, among the second subpixels, the threshold voltage of the second subpixel in a same row or a same column as the first subpixel as the alternative voltage.

12. The pixel circuit compensation method according to claim 1, wherein subsequent to determining the abnormal voltage, the pixel circuit compensation method further comprises writing information about the first subpixel corresponding to the abnormal voltage into a memory, wherein prior to adjusting the compensation signal to be applied to the first subpixel corresponding to the abnormal voltage, the pixel circuit compensation method further comprises:

extracting the information from the memory; and determining the first subpixel corresponding to the abnormal voltage in accordance with the information.

13. The pixel circuit compensation method according to claim 1, wherein prior to determining the abnormal voltage, the pixel circuit compensation method further comprises generating an image of back panel characteristics in accordance with the acquired threshold voltage.

14. A pixel circuit compensation device, comprising:

a voltage acquisition circuit configured to acquire a threshold voltage of a driving transistor in each subpixel of a display panel;

an abnormality determination circuit configured to determine whether there is an abnormal voltage in the threshold voltages; and a compensation adjustment circuit configured to adjust a compensation signal to be applied to a first subpixel corresponding to the abnormal voltage, wherein the abnormality determination circuit is further configured to:

determine whether the threshold voltages applied to all subpixels in a same row or a same column are the same; and when the threshold voltages applied to all the subpixels in the same row or same column are the same, determine the threshold voltages applied to all the subpixels in the same row or same column as the abnormal voltages.

15. The pixel circuit compensation device according to claim 14, wherein the abnormality determination circuit is further configured to:

determine whether each threshold voltage is within a predetermined voltage range; and when the threshold voltage is not within the predetermined voltage range, determine the threshold voltage as the abnormal voltage.

16. A display panel compensated by the pixel circuit compensation method according to claim 1.

17. A display device comprising the display panel according to claim 16.

* * * * *